US007712521B2

(12) United States Patent
Sorensen

(10) Patent No.: US 7,712,521 B2
(45) Date of Patent: May 11, 2010

(54) DEVICE OF A TEST PLUG

(75) Inventor: Tore Hassel Sorensen, Voss (NO)

(73) Assignee: TCO AS, Bergen (NO)

( * ) Notice: Subject to any disclaimer, the term of this patent is extended or adjusted under 35 U.S.C. 154(b) by 175 days.

(21) Appl. No.: 10/579,984

(22) PCT Filed: Nov. 22, 2004

(86) PCT No.: PCT/NO2004/000357

§ 371 (c)(1),
(2), (4) Date: Mar. 6, 2007

(87) PCT Pub. No.: WO2005/049961

PCT Pub. Date: Jun. 2, 2005

(65) Prior Publication Data

US 2007/0163776 A1 Jul. 19, 2007

(30) Foreign Application Priority Data

Nov. 21, 2003 (NO) ..... 20035196

(51) Int. Cl.
*E21B 33/12* (2006.01)

(52) U.S. Cl. ..... 166/179; 166/317

(58) Field of Classification Search ..... 166/250.07, 166/250.08, 179, 376, 317, 192
See application file for complete search history.

(56) References Cited

U.S. PATENT DOCUMENTS

| | | | | |
|---|---|---|---|---|
| 3,306,365 | A * | 2/1967 | Kammerer, Jr. | 166/318 |
| 4,354,554 | A * | 10/1982 | Calhoun et al. | 166/321 |
| 5,100,259 | A * | 3/1992 | Buelt et al. | 405/128.65 |
| 5,607,017 | A * | 3/1997 | Owens et al. | 166/288 |
| 6,474,414 | B1 * | 11/2002 | Gonzalez et al. | 166/277 |
| 6,896,075 | B2 * | 5/2005 | Haugen et al. | 175/57 |
| 6,923,263 | B2 * | 8/2005 | Eden et al. | 166/288 |
| 7,210,533 | B2 * | 5/2007 | Starr et al. | 166/376 |
| 2003/0000710 | A1 * | 1/2003 | Turley et al. | 166/386 |

FOREIGN PATENT DOCUMENTS

WO WO 0177484 A1 * 10/2001

* cited by examiner

*Primary Examiner*—Daniel P Stephenson
(74) *Attorney, Agent, or Firm*—Francis C. Hand; Carella, Byrne, Cecchi et al

(57) ABSTRACT

A device is described for a plug (12) for pressure testing of bore holes and the like in a formation or the like, and associated pipe (10) in which the plug is installed in a plug-carrying chamber (14), and the plug (12) seals the passage through the pipe by cooperating with sealing bodies (23, 25), with the underside of the plug (12) being arranged (rests) in a seat at the bottom of the chamber. The plug is characterized in that it comprises a number of layer-formed or tier-formed ring disc elements of a given thickness, on fitted on top of the other.

14 Claims, 3 Drawing Sheets

DEVICE OF A TEST PLUG

The present invention relates to a test plug for use in wells, such as oil and gas wells and water wells.

The invention also relates to different embodiments of devices for the pipe construction adapted to accommodate such a glass plug.

To use plugs of a material which can disintegrate or be crushed, such as a ceramic material or glass, is known. It is also known to use composite plugs that can withstand pressure one way only. These are known to be used in the US for example.

It is well known that production wells within the oil industry must be tested before they are taken into use. One of these tests concerns checking that the components of the well can withstand the pressure under which it shall be operating during oil/gas production. To carry out such tests, a plug is inserted that closes the passage down in the well. By supplying pressure from the surface with the help of a suitable fluid, one can check over time that the well is sufficiently watertight against leaks. Previously, plugs which were pulled up after use, were used. Lately, it has been desirable to use plugs which do not have to be pulled up again afterwards. That is, plugs which could either be opened, be crushed or be dissolved after used.

Solutions where the whole or parts of the plug are fabricated from rubber are also known previously, and where a section comprises a chemical that dissolves the rubber plug when the test is completed and one wishes to remove the plug. However, this method would be too uncertain and slow in operations from floating rigs, considering the high operating costs for such a platform, as one needs to know the exact time when the plug is removed and the passage opens. The drilling rig can not leave the well before the plug is opened, and the above mentioned solution can take days. This type of plug has later been replaced by plugs that can be crushed.

As examples of known crushable plugs, reference is made to U.S. Pat. No. 5,607,017 and U.S. patent application Ser. No. 2003/0168214A (based on Norwegian Patent Application 2000 1801).

A TDP-PLUG (=Tubing Disappearing Plug) can also be used to safeguard the well against blow-out situations, and also to fit pressure-activated equipment in a safe way. If not, one risks that fluids leak out of the well. In practice, the plug is fitted in the form of a TDP-plug in the lower part of the tubing/production pipe. The pipes are thereafter screwed together and guided down in the well until the plug reaches the correct depth.

The test plug is placed in a suitably adapted seat in the tubing/pipe, and gasket systems are used to achieve a sufficient seal against the surrounding inner pipe wall. The seals are placed in an adapted recess in the inner pipe wall and seal against the plug positioned radially inside in its seat.

It is also an object of the invention to provide a glass plug that can be fitted (or be driven) as a unit on its own, i.e. without being permanently fitted in a tubing. This will be plugs which are lowered into the well with Wireline or Coiled tubing. Such a plug will be hollow, i.e. have a through-going hole and often be equipped with an external gasket which can form a grip against the inner wall of the well, so-called slips, and with a glass plug fitted on the underside. The whole unit, the "Bridge-plug", is lowered down to a desired depth, expanded to give a sufficient grip and seal, and to provide a seal during the testing, or to stop a possible release of water.

Here, the customer can also remove the glass in the plug with explosives or blows/impacts and thereby avoid having to pull the plug out again. It is a known problem that plugs can be difficult to pull up, especially if they have been standing in the well for a long time.

An important aspect for this kind of use of plugs is that the glass plug can withstand rapid temperature changes. With the use of wireline, lowering to the full depth with the resulting high temperature can be rapid.

The new glass plug which is divided into layers is much better with respect to rapid heating than previously known solutions, such as in the above mentioned Norwegian Patent Application 2000 1801 (belonging to the applicant). Here, the glass is in one piece and can often be damaged by rapid heating as a consequence of internal stresses.

To use ceramics or glass as material in such plugs is well known, as is shown, for example, in the mentioned patent application 2000 1801. In general, glass is very appropriate as plug material for the oil industry. It is almost inert to all types of chemicals and it is safe for the personnel who shall handle the plug. Furthermore, glass retains its strength at high temperatures, and it can remain in an oil well for a very long time without being damaged or broken down structurally.

Ceramic/glass plugs comprise an explosive charge, which is detonated when the tests are completed so that the plug is crushed and the passage opens up for free through-flow. The advantage with such crushing is that the ceramic material or the glass is crushed to small particles that are simply flushed out of the well without leaving residues that can be harmful. Such explosive charges have normally been incorporated into the plug itself, in that one or more cut outs/holes for placing of the explosive charge have been drilled out from the top of the plug. However, this leads to a weakening of the plug structure, as scratches and fissure formations can easily arise in the glass when it is exposed to high pressures or pressure variations during the preparatory tests.

At the same time, the industry wants to be able to use higher working pressures in production wells. In our tests we have established that earlier versions of such plugs do not have sufficient strength and safety with regard to the number of load alterations, changes in direction of the load and temperature fluctuations. The customers also ask for plugs for steadily increasing working pressures. The development of well technology implies that today one must provide plug constructions that can withstand pressures of up to 1000 bar, so that they can be applied in modern high pressure wells.

It has been found that the shape of the crushable material and the composition of the plug itself are of vital importance for which pressure the plug withstands.

There are also valves and other systems on the market today which perform the same function as crushable plugs, for example, with flaps or taps that can be opened, but these have their obvious disadvantages: They are technically complicated, they have many moving parts and provide many possibilities for defects. They can easily be clogged up by silt/particles that enter the mechanisms. Such valves are consequently costly and are therefore in most cases omitted or rejected.

Based on the above, it is an aim of the invention to provide a new plug construction that overcomes the above mentioned disadvantages, i.e. a construction that can withstand higher pressures during the test procedures, rapid temperature swings and many and varied load changes. It is an aim of the present invention to provide a plug construction that can satisfy the above mentioned demand on plugs.

The plug construction according to the invention includes a pipe section having a chamber with an annular seat at a bottom, a plug installed in the chamber with an underside of the plug resting on the seat and sealing bodies between the plug and the pipe section to seal off any passage of fluid between the plug and the pipe section.

In accordance with the invention, the plug is formed of a plurality of disc-shaped glass elements in stacked relation to each other and a plurality of layers of a material other than glass disposed between the glass elements.

In another embodiment, the glass elements are glued together without any intervening layers of other materials.

The invention also provides a pipe section that is comprised of an enlarged section to define a chamber with an annular seat at the bottom of the chamber for receiving a plug and an annular shoulder below the enlarged section for receiving an annular device thereon after removal of a plug from on the annular seat.

With the present invention the following features are achieved: A stronger plug is obtained comprising a series of layers with tiers of glass. The construction is such that the glass can withstand several load changes and varying load changes than previously known plugs, i.e. it can withstand pressure changes between pressure from above or pressure from below.

The glass is divided up into functions, so that plates/discs of one disc type can ensure the hydraulic sealing against a liquid or a gas under pressure to which the plug is exposed, while another type of plate/disc functions to take up the load which arises as a result of the pressure against the glass area.

A series of tests have clearly shown that this division of labour is less of a strain on the glass than if the disc performs both the sealing and at the same time handles the load.

During special operations, such as in perforation with explosives just above the glass plug, it is also important to use several layers of glass, just to withstand the considerable jolts of pressure which this type of work leads to in the well.

The division into layers of the plug in plates/discs and possible lamination between each plate/disc leads to a much higher tolerance against breakages at rapid temperature changes than previously known plugs. This was a large problem with previously known technology.

The division into layers and the module construction ensure that one can produce a plug which is adjusted to the environmental conditions (pressure, temperature, etc.) one expects in the well where the plug is to be used. Of course, safety margins are being taken into account. Thus, one can specially adjust and build the plug according to the customer's pressure requirements. For example, a 1000 bar plug can be produced with 6-8 layers of glass, while a 300 bar plug can comprise of 2 to 4 layers.

It is important that the glass is hardened in such a way that it can be crushed, also by mechanical crushing, at the same time as it retains its strength. The hardening is carried out by heat treatment of the glass.

The invention shall now be explained in more detail with reference to the enclosed figures in which.

Figure 1:
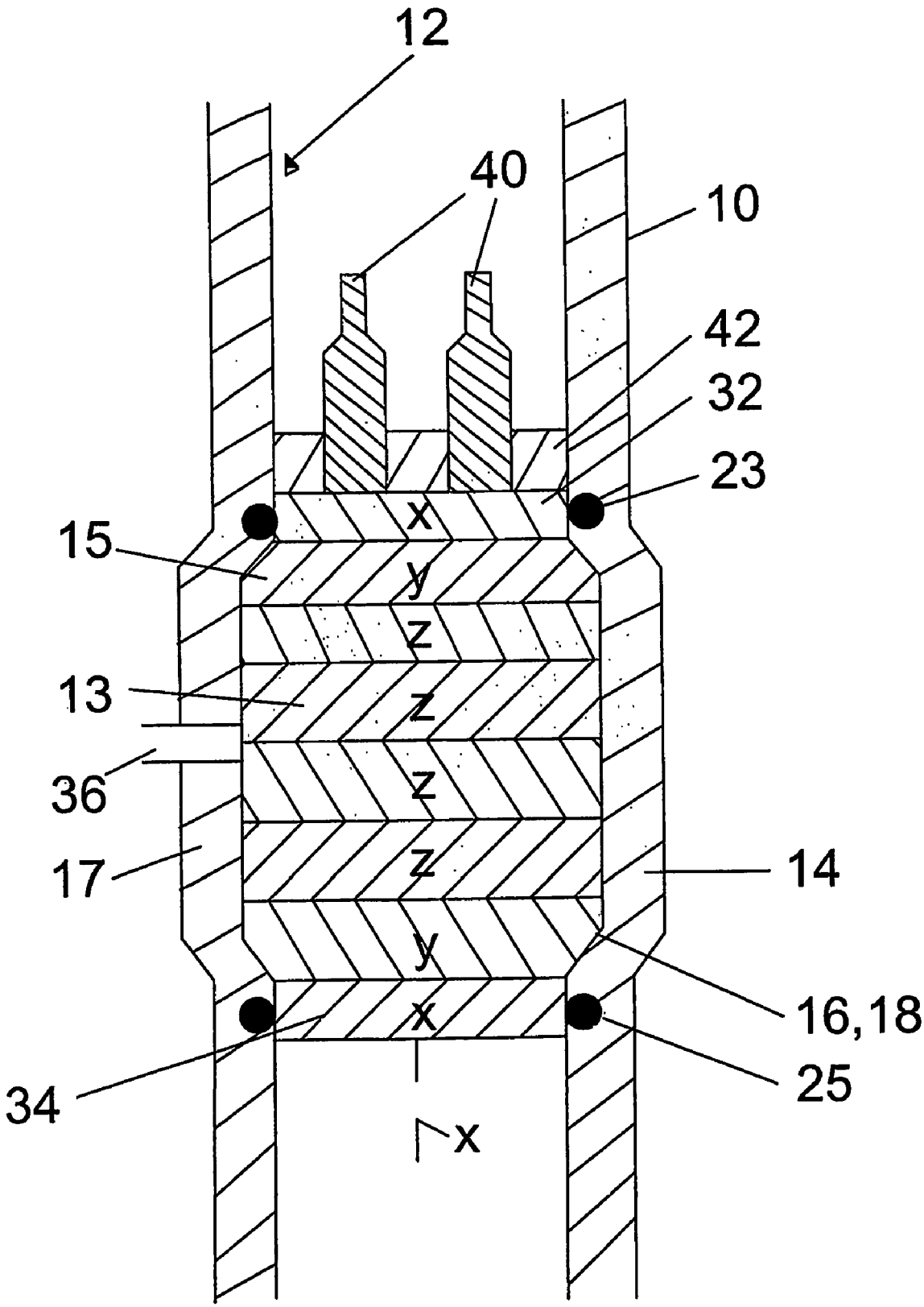
FIG. 1 shows a general diagram of the construction of a plug according to the invention, placed in a tubing/production pipe, where a venting hole is made through the surrounding pipe wall.

Reference is initially made to FIG. 1 which shows a tubing of production pipe 10 of the previously known type, and in which a plug 12 is fitted. The plug 12 is placed in a radially directed enlarged section 14 of the pipe 10. The section 14 has a slightly larger inner diameter than the rest of the pipe both to provide a safe positioning of the plug, and to avoid limiting the flow cross-sectional area when the plug is removed. The plug 12 is mainly cylindrical (even if other cross-section forms can be adapted to the cross-section of the pipe 10).

The underside 16 of the plug 12 forms a ring-shaped, slanted, shoulder-formed seat 18 in the bottom of the enlarged section in relation to the longitudinal axis X of the pipe 10. The upper part of the plug has also a slanted surface. In this way, the plug is more capable of withstanding high pressures and pressure pulses. The angle of contact of the plug 10 against the seat is about 45°.

The enlarged section 14 is designed so that it does not impede subsequent operation and maintenance of the well. Furthermore, the plug section diameter must not be too large because this can lead to the operator (the oil company) having to use casings/lining pipes with corresponding larger internal diameter. As the lining pipes can have lengths of 10 kilometers and more, a plug section which is too thick could lead to extra costs for the operator.

The plug's gasket construction 23, 25 in the inner wall forms a seal between the glass disc 32, 34, which lies just above and just below the plug-carrying pipe chamber 14, and the inner wall of the pipe. These glass discs are also denoted by 32, 34, and are arranged for the sealing function itself.

This gives a reduced load on the glass plug 12 itself, and the plug section can be made narrower and thereby reduce the diameter requirement of the lining pipe and the production pipe. The plug 12 is shaped as a cylinder and with a number of glass discs 13 in the middle with larger diameter than the seal-forming glass discs 32, 34.

The new plug construction according to the invention is characterised in that it is presented as a layer or tier formed construction where the one layer lies on top of the next layer. This can be seen in the figures.

The layers denoted by Z are manufactured as disc-shaped ring-plate elements with a given thickness. At each end of the mid-cylindrical section 13 of the plug 12, the slanted plates 15,17 are fitted, also denoted Y in the figure. At each end of the plug, the mentioned end discs 32 and 34 are mounted, denoted by X in the figure, which together with the peripherally fitted O-rings 23,25 form the plug's seal against the inner wall of the pipe 10, this to prevent leaks.

The plug according to the invention can consequently be manufactured with a required number of layers. According to a particularly preferred embodiment, a layer of a material other than glass is placed between the different layers in the plug. This to achieve a better protection of the glass with respect to impacts during handling, and also for the plug to be able to withstand higher pressures.

As an example of an inserted layer or inserted film, a plastic film, a felt film, a paper film or similar material can be used.

The inserted layer functions as lamination, for strength and/or as a gliding means and as a shock absorber. Alternatively, the glass plates can be joined together by lamination with a binding agent such as a glue.

By the use of pressure hardening, the glass can be made brittle. And with the correct tempering (pre-processing), the glass obtains strength, toughness and good crushing characteristics.

To obtain a satisfactory seal between each glass disc and between the outer surfaces of the glass and the inner wall of the pipe, the glass ought to be polished. This means that the glass plate is manufactured as frosted glass (Norwegian: "slip"). This gives a good fit between glass and metal, i.e. a satisfactory seal between each glass plate and between the outer surface of the glass and the metal of the inner pipe wall.

To simplify the industrial production and provide a simpler fitting and best possible functioning, a balancing hole 36 is drilled from the centre of the plug and radially out through the tubing or the pipe section 10/14 in which the plug 12 is placed. The hole 36 is drilled radially into the centre of the enlarged section 14. When the two upper and lower glass plates 15*a*, 15*b*, respectively, see FIG. 2, during the fitting of the plug 10 in the workshop, are guided towards each other to lie against each other along the borderline 38, the air will be vented out through the hole 36 in the pipe wall 10 as a consequence of the narrow passage.

The hole 36 offers a safe fitting of the inner layered plug parts against each other. Without this hole, the whole plug would have to be fitted in a vacuum to avoid great overpressure between the glass discs when they are put together and this would be bothersome and expensive and the plugs would not function optimally. This hole 36 is also used to balance the pressure on the glass surfaces when the plug is situated down in the well.

This balancing hole 36 in the housing also functions to reduce the pressure load on the plug. Without such a balancing via the hole 36, one can potentially end up exceeding the pressure rating or the tolerance limit for the plug. This is because the pressure inside the glass plug which is between the discs is initially atmospheric (1 bar absolute pressure). But when the plug is fitted at depths of 2-3 km, and the well is filled with water in the test phase, the hydrostatic pressure alone will amount to 2-300 bar. In addition comes the test pressure which is typically 350 bar in a standard well. In all, one can have a pressure difference of 300+350=650 bar for the glass discs in which there is initially atmospheric pressure. By using the hole 36 as a ventilation hole or one way valve, as mentioned in the paragraph above, then one can balance the hydrostatic pressure and reduce the differential pressure to the test pressure alone i.e., a pressure of 350 bar.

Figure 3:
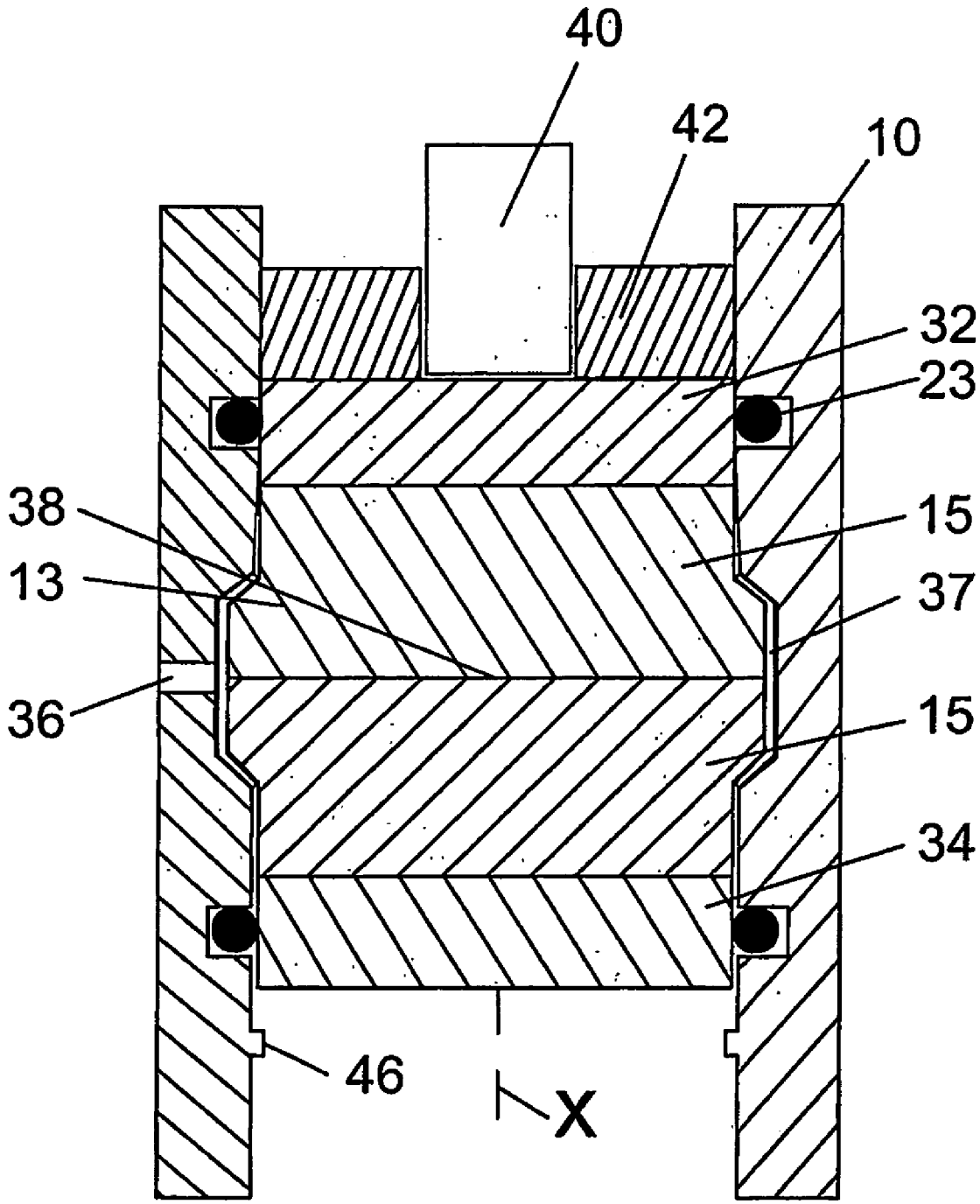
FIG. 3 shows a variant of the above mentioned plug, and comprising an explosive charge in a separate glass section.

According to a preferred embodiment, the glass plug is placed in a seat or so-called "crib" 37 of a high-grade, softer material. This material is preferably a metal such as bronze. As shown in FIG. 3, the seat 17 has a shape that corresponds to the peripheral outer side surface of the enlarged plug section 13, so that it can lie steadily placed in the enlarged pipe section. This solution will safeguard the plug against damage from rough treatment, for example, during lifting with cranes and the like, before the section is fitted into the pipe section 10. The same crib 17 can also be used as a support and receptacle for the forces which the pressure exerts against the area of the glass. This force can, for example, be 150 metric tonnes. This means that the glass rests in the crib which in turn rests against the surrounding pipe section.

The glasses are polished and preferably shaped differently pending on their function, where one type of glass can constitute the pressure sealing (17-18), while another type handles the load that is exerted by the fluid pressure.

As can be seen initially, the glass plug can be removed with the help of an included explosive charge 40 that is fastened to the glass or to the inside of the plug housing. An embodiment is shown in FIG. 1 where the explosive charges 40 are fastened inside a dedicated separate glass disc 42 which lies on top of and close to the sealing end plate 32. This disc 42 is called an anchorage for the explosive charge. When the disc 42 is exploded, the glass plug is completely crushed, as the anchorage of the disc 42 is completely crushed also.

Concerning the detonation of the plug itself, this can occur by remote control from the surface with the help of a controlled pump pressure provided with the use of the pumps of the oil platform. Timers can also be used to detonate and remove the plug after predetermined time intervals.

The manufacture of the pipe section that shall contain such a plug 12, is carried out in advance in an assembly workshop. This means that the plug can be assembled in modules with suitable qualities of materials etc., to meet different needs dependent on the conditions at the location of use. It also means that the plug length can easily be adjusted by varying the number of glass plates that are placed in the stack to make up the plug.

Figure 2:
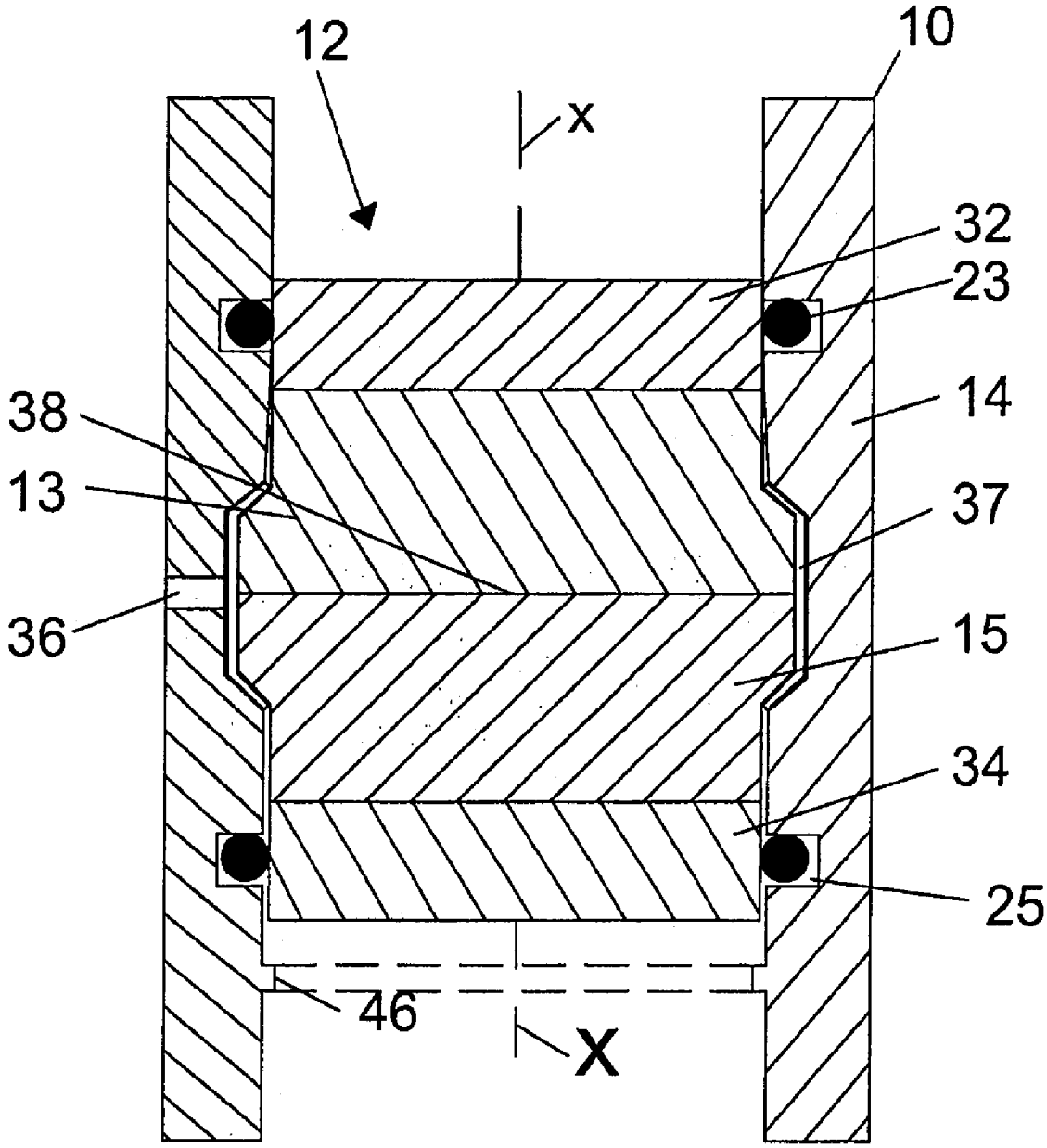
FIG. 2 shows an alternative embodiment of the plug, i.e. for the number of layers in the plug.

FIGS. 1 and 2 show two different constructions. FIG. 1 shows a plug with four Z-type glass plates, while FIG. 2 shows a plug with only two glass discs of the Z type. FIG. 1 also shows the additional explosive glass disc 42, while the plug according to FIG. 2 does not have this type of explosive charge.

When the glass plug is later exploded and the pipe has been opened for flow of fluid, this shorter pipe section remains in the pipe. Then the section can later be used to install and contain mechanically operated plugs to carry out other testing or safeguarding of the well.

A so-called "No-Go" shoulder, which is here shown by the reference number 46, is implemented at the plug housing. This is shown by the reference number 46 in FIG. 2. The shoulder is shaped as a ring-formed inwardly turning fold 46 or shelf in the pipe. It will not disturb the flow in the pipe much, or obstruct the equipment which shall later be lowered past the plug section.

The shoulder 46 can be used to secure mechanical plugs which are later lowered down in the pipe. A plug which has approximately the same inner diameter as the pipe, and which is lowered down, will rest with its underside on the so-called "no-go" shoulder 46. With this shoulder form 46 it is possible to fix a "slickline-plug" to this seat. This anchorage is often called as "equipment which is suspended". This means that in later well operations one can suspend plugs or other equipment in the same recess, where the glass plug was originally installed and establish both a secure anchorage and a sealing function in this area. The equipment is thereby prevented from passing the shoulder section 46.

FIG. 3 shows this variant in the form of an explosive fastening 40 in the disc 42 and a so-called No-Go shoulder 46 at the bottom for placing of "dumb" slickline plugs. After the glass is removed, such plugs can be driven down toward No-Go and be placed there without advanced depth control and adjusted to be anchored or rest against the shoulder 46. The well can thereafter be safeguarded with this plug for work or for testing.

Furthermore, both FIGS. 2 and 3 show the embodiment with the radially enlarged middle section 15 of the plug unit 13 (which is formed by the two upper and lower glass discs 13, respectively) that rests against the slanted seat 18 in the pipe wall.

The invention claimed is:

1. A test plug for a well comprising a pipe section having a chamber with an annular seat at a bottom of said chamber;

a plug installed in said chamber with an underside of said plug resting on said seat, said plug including a plurality of disc-shaped glass elements in stacked relation to each other and a plurality of layers of a material other than glass, each said layer of a material other than glass being disposed between a pair of said glass elements, each said glass element being formed with a polished surface to obtain a satisfactory seal between said polished surface and a metal inner wall of said pipe section; and sealing bodies between said plug and said pipe section to seal off any passage of fluid between said plug and said pipe section.

2. A test plug as set forth in claim 1 wherein each said layer is made of a material selected from the group consisting of a plastic film, a felt film and a paper film.

3. A test plug as set forth in claim 1 characterized in that said glass elements are hardened and crushable.

4. A test plug as set forth in claim 1 further comprising a frame of a high grade softer material than said glass elements encasing said plug to safeguard said plug against damage from rough treatment.

5. A test plug as set forth in claim 1 wherein said glass elements include one type of glass for pressure sealing and a second type of glass for liquid pressure loading.

6. A test plug as set forth in claim 1 further comprising an explosive charge in said plug for disintegrating said plug.

7. A test plug as set forth in claim 6 wherein said explosive charge is disposed in an uppermost one of said glass elements.

8. A test plug as set forth in claim 1 wherein said plurality of disc-shaped glass elements include at least one glass element of uniform thickness, a second glass element with a slanted lower edge below said one glass element for seating on said annular seat of said pipe section, a third glass element with a slanted upper edge, a fourth glass element sealing against one of said sealing bodies and a fifth glass element sealing against another of said sealing bodies.

9. A test plug as set forth in claim 1 wherein said plurality of disc-shaped glass elements include a first glass element having an intermediately disposed slanted portion facing downwardly for seating on said annular seat of said pipe section, a second glass element having an intermediately disposed slanted portion facing upwardly, a third glass element below said first glass element sealing against one of said sealing bodies and a fourth glass element above said second glass element sealing against another of said sealing bodies.

10. A test plug as set forth in claim 9 further comprising a fifth glass element above said fourth glass element and an explosive charge in said fourth glass element for disintegrating said plug.

11. A test plug as set forth in claim 1 wherein each said sealing body is an O-ring.

12. A test plug as set forth in claim 1 wherein said pipe section includes an annular shoulder below said chamber for receiving an annular device thereon after removal of said plug.

13. A test plug as set forth in claim 1 wherein said pipe section has a venting hole for venting air from between said glass elements during assembly thereof in said pipe section.

14. A test plug for a well comprising a pipe section having a chamber with an annular seat at a bottom of said chamber;

a plug installed in said chamber with an underside of said plug resting on said seat, said plug including a plurality of disc-shaped glass elements in stacked relation to each other and a plurality of layers of a material other than glass, each said layer of a material other than glass being disposed between a pair of said glass elements;

a frame of a high grade softer material than said glass elements encasing said plug to safeguard said plug against damage from rough treatment; and sealing bodies between said plug and said pipe section to seal off any passage of fluid between said plug and said pipe section.

* * * * *